US005355851A

United States Patent [19]

Kamiya

[11] Patent Number: 5,355,851

[45] Date of Patent: Oct. 18, 1994

[54] LUBRICATING OIL SUPPLYING SYSTEM FOR TWO CYCLE ENGINE

[75] Inventor: Tsuyoshi Kamiya, Iwata, Japan

[73] Assignee: Yamaha Hatsudoki Kabushiki Kaisha, Iwata, Japan

[21] Appl. No.: 969,391

[22] Filed: Oct. 30, 1992

[30] Foreign Application Priority Data

Feb. 10, 1992 [JP] Japan ..... 4-056620

[51] Int. Cl.[5] ..... F01M 1/16

[52] U.S. Cl. ..... 123/196 R; 123/73 AD; 184/7.4

[58] Field of Search ..... 123/196 R, 196 CP, 196 W, 123/73 AD, 506, 503, 510; 184/7.4, 6

[56] References Cited

U.S. PATENT DOCUMENTS

| | | | |
|---|---|---|---|
| 3,779,225 | 12/1973 | Watson et al. | 123/506 |
| 4,385,614 | 5/1983 | Eheim et al. | 123/506 |
| 4,396,151 | 8/1983 | Kato et al. | 123/510 |
| 4,446,833 | 5/1984 | Matsushita | 123/435 |
| 4,655,183 | 4/1984 | Taira et al. | 123/503 |
| 4,726,330 | 2/1988 | Shiga | 123/73 AD |
| 4,758,130 | 7/1988 | Waterworth | 123/196 R |
| 4,829,967 | 5/1989 | Nuti | 123/73 AD |
| 4,904,163 | 2/1990 | Tachi | 417/53 |
| 4,967,700 | 11/1990 | Torigai | 123/73 AD |
| 4,989,555 | 2/1991 | Matsuo et al. | 123/73 AD |

FOREIGN PATENT DOCUMENTS

| | | |
|---|---|---|
| 2411513 | 9/1975 | Fed. Rep. of Germany . |
| 62-131908 | 6/1987 | Japan . |
| 1044711 | 2/1989 | Japan . |
| 192505 | 4/1989 | Japan . |
| 2191807 | 7/1990 | Japan . |
| 2118110 | 9/1990 | Japan . |
| 2118111 | 9/1990 | Japan . |
| 2139307 | 11/1990 | Japan . |

OTHER PUBLICATIONS

Patent abstracts of Japan vol. 12, No. 121 (M-686) (2968) 15 Apr. 1988 & JP-A-2 248 812 (Nippon Soken Inc) 29 Oct. 1987 and Patent abstracts of Japan vol. 10, No. 204 (M-499) (2260) 17 Jul. 1986 & JP-A-61-46 409 (Mazda Motor Corporation) 6 Mar. 1986 and European Search Report EP 93 10 2059 dated Mar. 31, 1993.

*Primary Examiner*—E. Rollins Cross
*Assistant Examiner*—Erick Solis
*Attorney, Agent, or Firm*—Knobbe, Martens, Olson & Bear

[57] ABSTRACT

A lubricating system for an engine and particularly for a two cycle crankcase compression internal combustion engine wherein the amount of lubricant supplied by a reciprocating pump to the engine is varied by selectively delivering lubricant to the engine and bypassing lubricant from the pump back to the inlet side of the pump. The total amount of lubricant supplied is controlled by setting a duty ratio at the beginning of a control cycle and varying the time of the control in response to engine condition sensed during the control cycle so as to provide good transient control.

39 Claims, 6 Drawing Sheets

LUBRICATING OIL SUPPLYING SYSTEM FOR TWO CYCLE ENGINE

BACKGROUND OF THE INVENTION

This invention relates to a lubricating oil supplying system for a two cycle engine and more particularly to an improved system for supplying and controlling the amount of lubricant to such engines.

In order to improve the lubrication of engines, particularly those operating on the two cycle principle, and to ensure against the emission of unwanted exhaust gas constituents, various separate lubricating systems have been proposed wherein lubricant is supplied to the engine from a lubricant pump in metered quantities rather than being mixed with the fuel. Such arrangements permit greater control over the amount of lubricant supplied to the engine and thus improve both lubrication and exhaust emission control.

Various ways have been proposed for controlling the amount of lubricant supplied to the engine. One way in which the quantity of lubricant supplied can be controlled is by providing a plunger type pump and varying both the strike and speed of the pump. Such mechanisms are quite complicated and can add to the cost of the system. Another way in which the amount of lubricant supplied is controlled is by employing a positive displacement pump that may or may not have its output stroke varied and a control valve which selectively supplies lubricant from the pump to the engine or returns it back to the return side of the pump. The amount of lubricant supplied is controlled by varying the duty ratio (ratio of supply time to total time of a given cycle).

Although all of the aforedescribed methods can provide good lubricant control, there is a disadvantage with most of the systems previously proposed. That is, then the lubricant supplied to the engine is initiated, this is, done in response to the engine running condition at that timed However, if the engine running condition varies during the control period, then an improper amount of lubricant supply will be supplied. For example, if the lubricant supply period is begun when the engine is running at a high speed and the engine is thereafter decelerated, an excess amount of lubricant will be supplied which will result in excess lubricant in the exhaust gases and poor emission control. On the other hand, if the lubricant supply is initiated when the engine is running at a low speed and the engine is thereafter accelerated during the same control cycle, then inadequate lubrication may be supplied to the engine.

It is, therefore, a principal object of this invention to provide an improved lubricant supply system for an engine and an improved control therefor.

It is a further object of this invention to provide an improved lubricating system for an engine that can cope with changes in running conditions during the control cycle.

Although systems have been proposed that can monitor the engine running conditions and change the supply characteristics during a given supply cycle, the systems which have been proposed are somewhat complicated and expensive. It is, therefore, a still further object of this invention to provide an improved and simplified lubricant control system for an engine that can be responsive to changing conditions and still be relatively low in cost and simple in operation.

SUMMARY OF THE INVENTION

The invention is adapted to be embodied in a lubricating system for an internal combustion engine that comprises a lubricant pump for pumping lubricant. A control valve is also incorporated for receiving lubricant from the lubricant pump and is operable cyclically between a delivery condition wherein lubricant is delivered to the engine for a delivery time and a condition wherein lubricant is not delivered to the engine for a non-delivery time. The sum of the delivery time and the non-delivery time for a cycle comprise the control time and the ratio of delivery time to control time for a given cycle comprises the duty ratio. Engine running conditions are also sensed by an appropriate sensor.

In accordance with a first feature of the invention, control means are provided for controlling the amount of lubricant supplied to the engine during a given cycle by sensing the engine running condition at the beginning of a control cycle, by holding one of the delivery and non-delivery times during that cycle constant in response to the sensed engine running condition at the beginning of the cycle and varying the duty ratio by varying the other of the delivery and non-delivery times during the cycle in response to engine conditions sensed after the cycle has begun.

In accordance with another feature of the invention, a control method is provided for controlling the amount of lubricant supplied to the engine during a given cycle by sensing the running condition at the beginning of a control cycle and holding one of the delivery and non-delivery times constant during that cycle in response to the sensed engine running condition at the beginning of that cycle. The duty ratio is then varied by varying the other of the delivery and non-delivery times during that cycle in response to engine conditions sensed during the cycle.

DETAILED DESCRIPTION OF THE PREFERRED EMBODIMENTS OF THE INVENTION

Figure 1:
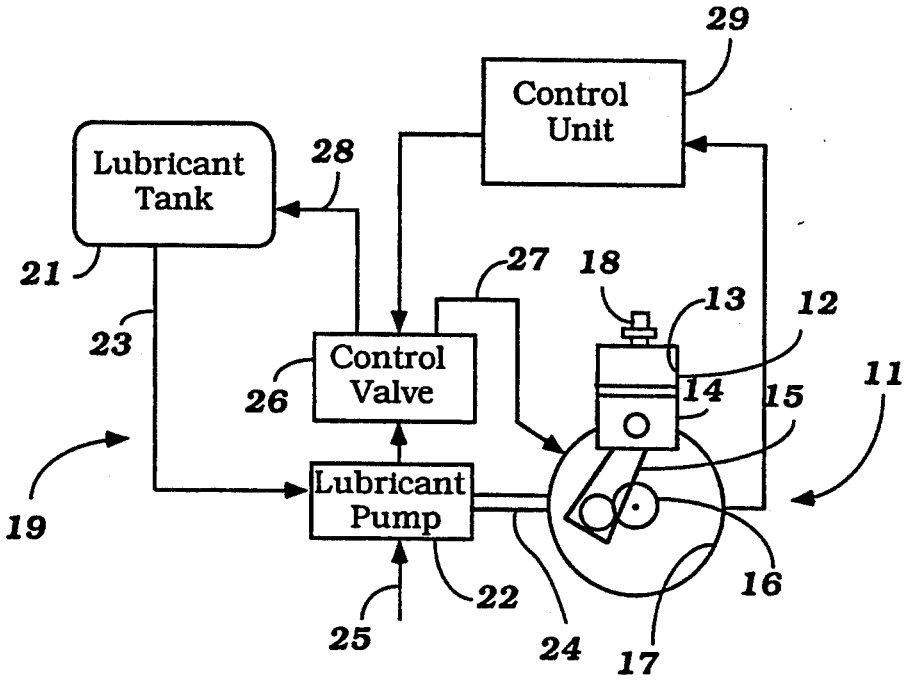
FIG. 1 is a schematic view of a lubricant supply system and method of operating it for an internal combustion engine constructed in accordance with an embodiment of the invention.

Referring now in detail to the drawings and initially to FIG. 1, this figure is a schematic view showing how the lubrication system constructed and operated in accordance with an embodiment of the invention can be applied to a two cycle crankcase compression internal combustion engine, indicated generally by the reference numeral 11 and shown in schematic form. Although the invention is described in conjunction with a two cycle crankcase compression engine, it should be understood that facets of the invention may be employed with other types of engines.

Since the construction of the engine 11 per se forms no part of the invention, except for the structure and method by which it is lubricated, a detailed description of the engine is not believed to be necessary. However, as may be seen in FIG. 1, the engine 11 is depicted as being of a single cylinder type having a cylinder block 12 with a cylinder bore 13 in which a piston 14 is supported for reciprocation. The piston 14 is connected by means of a connecting rod 15 to a throw of a crankshaft 16 that is rotatably journaled within a crankcase chamber 17. As is typical with two cycle engine practice, a charge of either air and/or air and fuel is admitted to the crankcase chamber 17 from an induction system (not shown) and is compressed on downward movement of the piston 14 and then transferred to the area above the piston 14 through one or more scavenge ports. If the engine is a spark ignited engine, the charge is then fired by a spark plug 18 and as the burning charge expands and drives the piston 14 downwardly. An exhaust port (not shown) will be opened for exit of the exhaust gases, in a well known manner.

The lubricating system, indicated generally by the reference numeral 19, includes a lubricant tank 21 in which a quantity of lubricant is stored. The lubricant is delivered from the lubricant tank 21 to a lubricant pump 22 through a supply conduit 23. The lubricant pump 22 is, in the illustrated embodiment, driven by the engine and a pump driveshaft 24 is provided for this purpose which is driven from the crankshaft 16 in any known manner. The lubricant pump may be of any known type but preferably is of the reciprocating piston type and will output a finite amount of lubricant for each of its strokes. If desired, the lubricant pump 22 may comprise a variable displacement pump of the type shown in the co-bending application entitled, "Lubricating Oil Supplying Device for an Engine," Ser. No. 07/895,919 filed Jun. 9, 1992 in the name of Seiichiro Yamada and assigned to the assignee hereof. In accordance with an important feature of the invention, however, a variable displacement pump is not required. The stroke adjusting mechanism for the pump 22 is shown schematically at 25 and may control the stroke of the pump dependent upon the speed of the engine 11 as determined from a suitable sensor, to be described.

The pump 22 outputs lubricant to a control valve, indicated generally by the reference numeral 26, and having a construction as described and illustrated in co-pending application entitled, "Lubricating Oil Supplying System for Two Cycle Engine," Ser. No. 07/862,984, filed Apr. 7, 1992 in the name of Yoshinobu Yashiro, and assigned to the assignee hereof. This control valve 26 selectively delivers lubricant to the engine through a supply conduit 27 or returns it to the lubricant tank through a return conduit 28. As described in the aforenoted co-pending application describing the pump, the control valve 26 is a three-way valve operated by an electrical solenoids and constructed so that when the solenoid is not energized, the control valve will supply lubricant to the engine through the delivery conduit 27. When the solenoid is energized, the control valve will be in a bypass or return position and return lubricant to the lubricant tank 21 through the return conduit 28.

Figure 2:
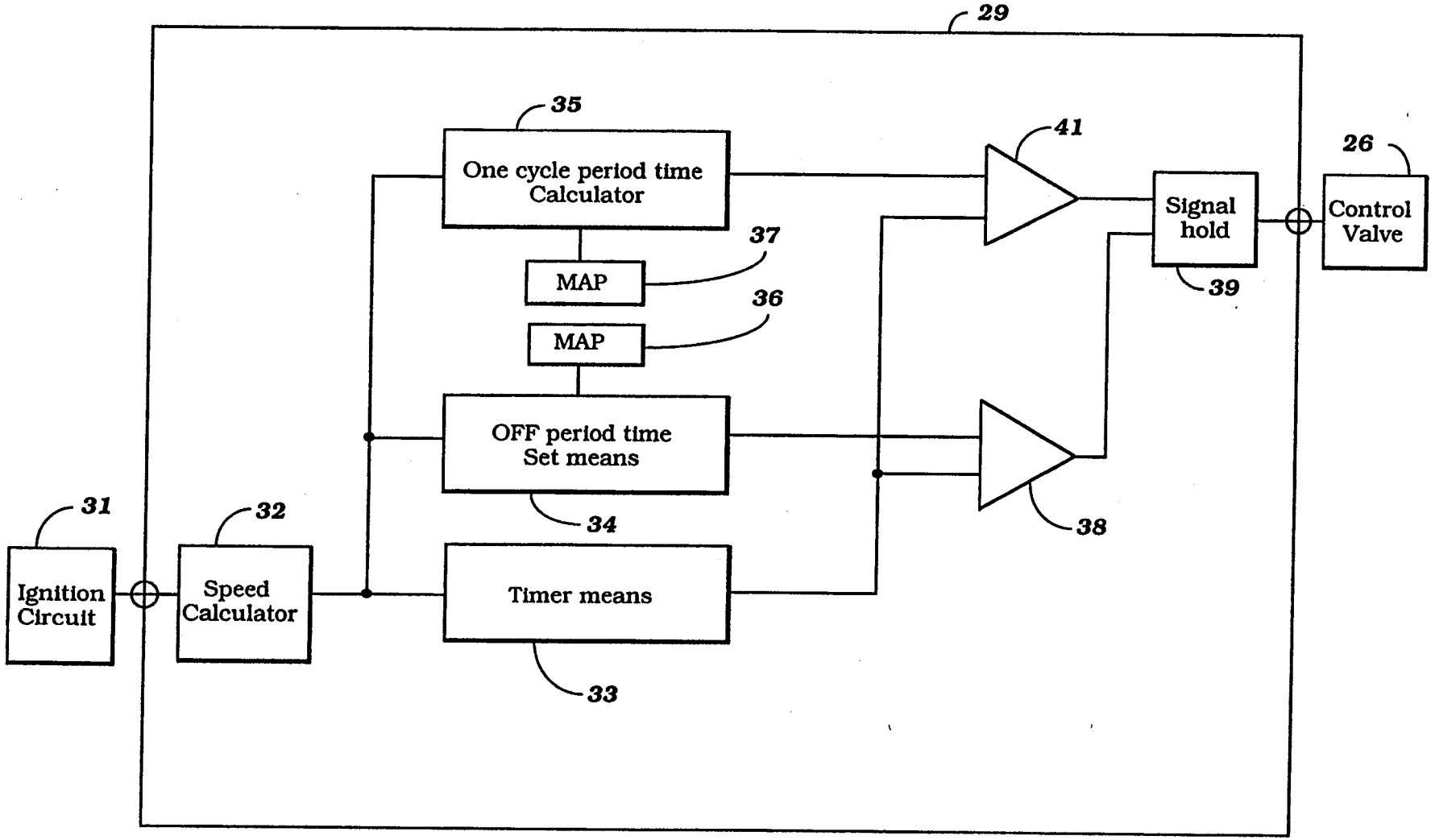
FIG. 2 is a schematic block diagram showing the components of the control system for the lubricant control valve.

The control valve 26 is controlled by a control unit, indicated generally by the reference numeral 29 and having a construction as will be now described by reference to FIG. 2. In FIG. 2 the control unit 29 is shown in block form and receives a signal from an ignition circuit 31 of the engine which provides a signal that is indicative of the speed of rotation of the engine crankshaft 16. The control unit 19 includes a speed calculator circuit 32 that receives the pulses from the ignition circuit 31 and outputs a signal to a number of internal components including a timer 33, an off period setting time means 34 and a one cycle period time calculator 35. In addition, internal maps 36 and 37 are preprogrammed and supply information to the off period time setting means 34 and the one cycle period time calculator 35, as will become apparent.

The timer 33 and off period setting means 34 output their signals to a comparator 38 which, in turn, will output a signal to a holding circuit 39 at an appropriate time, as will be described. In a similar manner, the timer 33 also outputs a signal to a second comparator 41 which also receives a signal from the one cycle period time calculator 35 and outputs a signal to the hold circuit 39 when these signals coincide.

The signal hold circuit 39 outputs an electrical current to the control valve 26 and more specifically its solenoid so as to switch this solenoid on or off and to turn the control valve 26 to its on or return position and its off or delivery position in the manner aforenoted.

Figure 3:
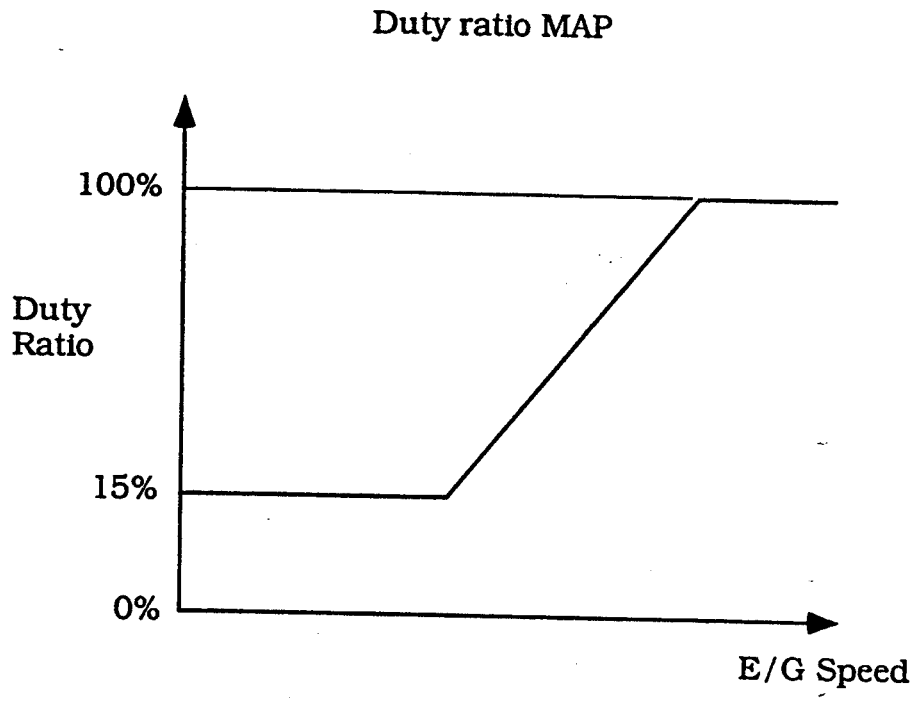
FIG. 3 is a graphical view showing the duty ratio map in response to engine speed in accordance with an embodiment of the invention.

As has been noted, maps are programmed into the system, these maps being indicated by the reference numerals 36 and 37 in FIG. 2. The map 37 is a duty ratio map as shown in FIG. 3 which adjusts the duty ratio from a minimum condition, which may be considered to be 15% in a preferred embodiment to a maximum of 100% (supply only) at a higher engine speed condition. Between these two points, the curve is provided with a ramp whereby the duty ratio gradually increases.

Figure 4:
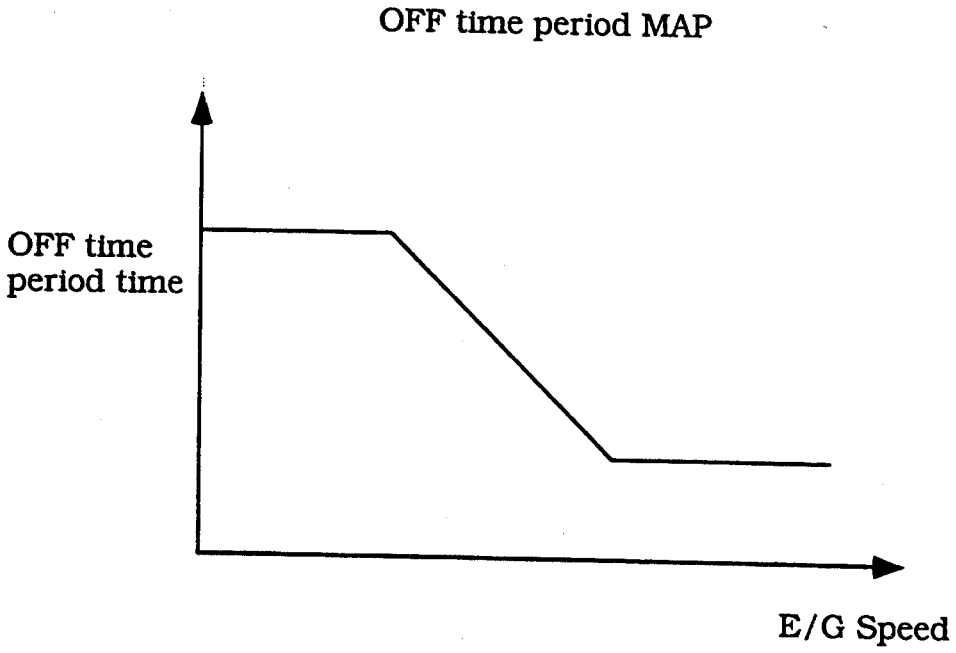
FIG. 4 is a graphical view showing a delivery time map in response to the engine speed in accordance with this embodiment of the invention.

The map 36 is the off or delivery period map and an embodiment is shown in FIG. 4 wherein the maximum off time occurs at low engine speeds and is held constant until a certain predetermined speed is reached. At this time, the off period gradually decreases down to a minimum as shown in this figure. It will be understood that it is not necessary to change the off period time, which is the delivery time, but this may be kept constant if desired.

Figure 5:
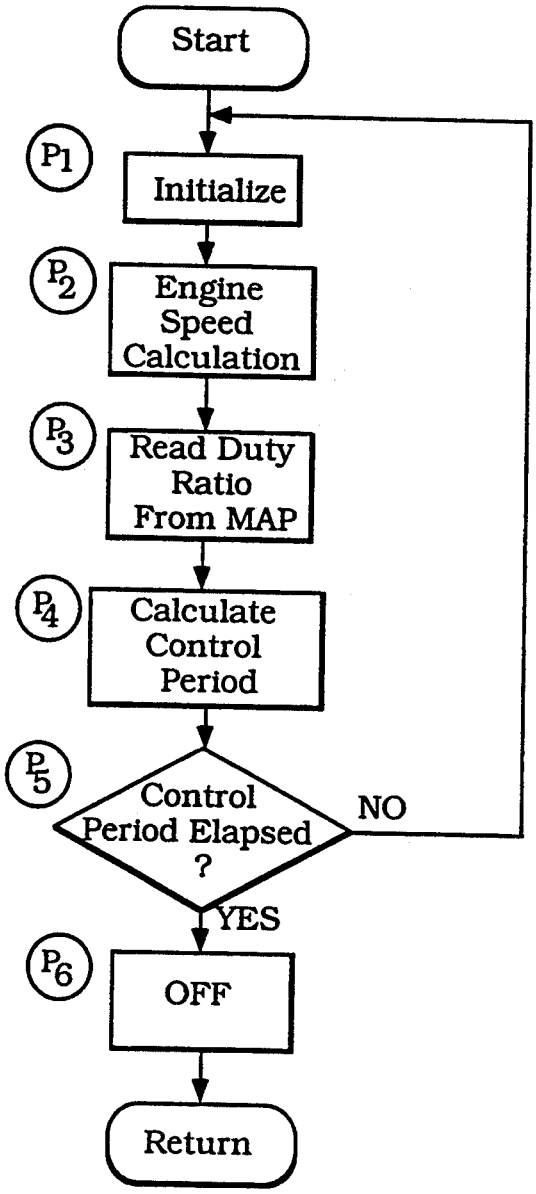
FIG. 5 is a block diagram showing a phase of the control routine.

A simple form of control routine under which the invention may operate is shown in FIG. 5 and will now be described. When the ignition is turned on and the engine is first started, the program moves to a step $P_1$ to initialize the system by resetting the timer 33.

The program then moves to the step $P_2$ so as to permit calculation of the engine speed by the engine speed calculator 32 based upon the output signal from the ignition circuit 31. The program then moves to the step $P_3$ so as to determine the duty ratio from the duty ratio map of FIG. 3 based solely upon engine speed. Although the invention is described in conjunction with a system that sets duty ratio based only upon engine speed, it is to be understood that other engine running condition parameters may be employed either with or in lieu of the engine speed calculator and those skilled in the art can readily understand how this can be accomplished.

At the step $P_4$, the control period, the entire time for one cycle of operation is calculated by dividing the off time period from the map of FIG. 4 derived by the map 36 and dividing this by the duty ratio which has been previously determined so as to give the one cycle time period. This time period is referred to as the control time in the specification and claims.

The program then moves to the step $P_5$ so as to count the number of timer pulses which have been generated by the timer 33 and compare them with the control time. If the control time is not met, the program repeats. If, however, the control time is reached, the program then moves to the step $P_6$ so as to de-energize the solenoid and turn the control valve 26 back on to initiate another supply period. The program then repeats to the step $P_1$. It should be understood that sometime during the program beginning with the step $P_3$, the control device will output a signal to turn on the solenoid for the control valve 26 and initiate return flow. The manner in which this is done will now be described by reference to FIGS. 6 and 7.

Before describing these figures, however, the control strategy will be described generally. The way the system operates is that at the start of each control time cycle, the solenoid will be turned off and an amount of lubricant will be delivered to the engine depending upon the pump output. Generally it is preferable to set the output of the pump at a single stroke as to be the necessary minimum amount of lubricant required by the engine, for example, during idle. Once the initiation of fuel delivery is determined by the running condition of the engine at the time immediately before, delivery is begun. A duty ratio is then set in accordance with the map of FIG. 3 and the delivery time is set, in one preferred embodiment of the invention, at a fixed time for a given running condition. The engine running condition is then monitored and if a change in condition is noted, the control unit 29 appropriately adjusts the duty ratio in accordance with the map of FIG. 3 so as to vary the off time. That is, total cycle time and total return or non-delivery time are varied under this condition while delivery time is held constant. Of course, the opposite can be true. That is, the total return time can be varied and the delivery time held fixed. It is preferable and simpler, however, to hold the delivery time fixed and vary the return time.

Using this type of control routine, it will be ensured that an appropriate amount of lubricant will be supplied to the engine and yet the engine can adapt to changes in running condition even during a single cycle of operation so as to ensure adequate and not excessive lubricant flow.

Figure 6:
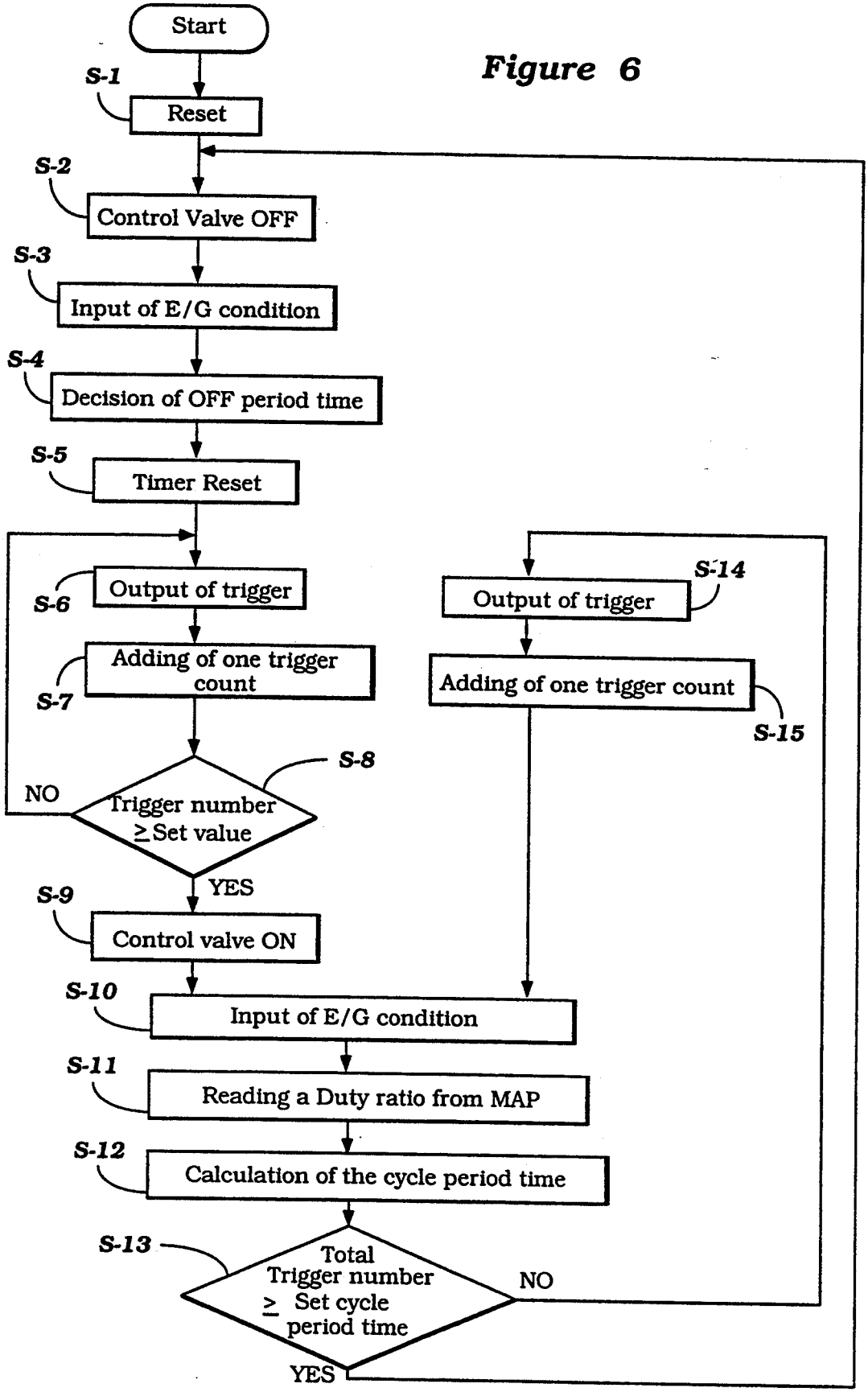
FIG. 6 is block diagram showing the total control routine in accordance with an embodiment of the invention.

A more detailed description of the way the program works will now be made by reference particularly to FIGS. 6 and 7, as aforenoted. Referring first to FIG. 6, the program once it starts moves to step $S_1$ so as to reset, as previously described. Then the program moves to the step $S_2$ so as to de-energize the solenoid of the control valve 26 and cause it to be in its flow permitting position. The program then moves to the step $S_3$ so as to record the input of the engine speed and any other conditions which may be desired.

Once this is done, the program moves to the step $S_4$ to read the off time period from the map of FIG. 4. The off time period is the period of supply of lubricant, as has been noted. In a preferred embodiment and as seen in FIG. 4, the off or supply time is held at a maximum at low engine speeds and then decreases in accordance with a ramp function as the engine speed increases and then is held constant again at a lower time as the engine speed is at a high engine speed. This is done so that the system will supply adequate lubricant at low speeds and will not undergo variations in output. However, as higher speeds are reached, the off or delivery time is reduced so that the system can react faster during conditions when transients are more likely to occur.

The program then moves to the step $S_5$ so as to reset the timer and then to the step $S_6$ so that the timer 33 outputs a time pulse both to the comparators 38 and 39. At the step $S_7$ this adds a further trigger pulse. The program then moves to the step $S_8$ so that the comparator 38 may make a comparison between the number of pulses generated by the timer 33 and the number of pulses necessary to generate the desired off time as set by the off period time setting means 34. If these numbers do not coincide, the program moves back to the step $S_6$ and repeats.

However, if it is determined at the step $S_8$ that the off time period (delivery time) is the desired time determined from the map of FIG. 4, the program then moves to the $S_9$ wherein the comparator 38 outputs a signal to the signal holding circuit 39 which, in turn, outputs a current to the solenoid of the control valve 26 so as to energize it and switch the control valve 26 to the return position. The program then moves, to the step $S_{10}$ so as to again read the engine condition and then moves to the step $S_{11}$ so as to read a duty ratio from the map of FIG. 3. This duty ratio is then fed to the calculator 35 which determines the control time at the step $S_{12}$. As has been previously noted, this is the time of the off period from FIG. 4 divided by the duty ratio of FIG. 5.

The program then moves to the step $S_{13}$ as to set in the comparator 41 the total time period calculated. At the same time, this comparator 41 compares that time period with all of the time periods previously accumulated as output by the pulses of the timer 33 including all of the time when the control valve 26 was in its delivery position. If the control time period exceeds that of the delivery time period (duty ratio less than 100%) and this point has not been reached the program moves to the step $S_{14}$ to generate a further timer trigger pulse from the timer 33 and at the step $S_{15}$ adds this to the comparator 41. The program then repeats through the steps 10, 11 and 12 so as to again sense the engine condition, read the duty ratio, calculate the time period and make a determination at the step $S_{13}$ if the time period for the present engine running condition has been met. If it has, the program returns back to the step $S_2$ wherein the solenoid of the control valve is turned off to again initiate lubricant delivery.

Figure 7:
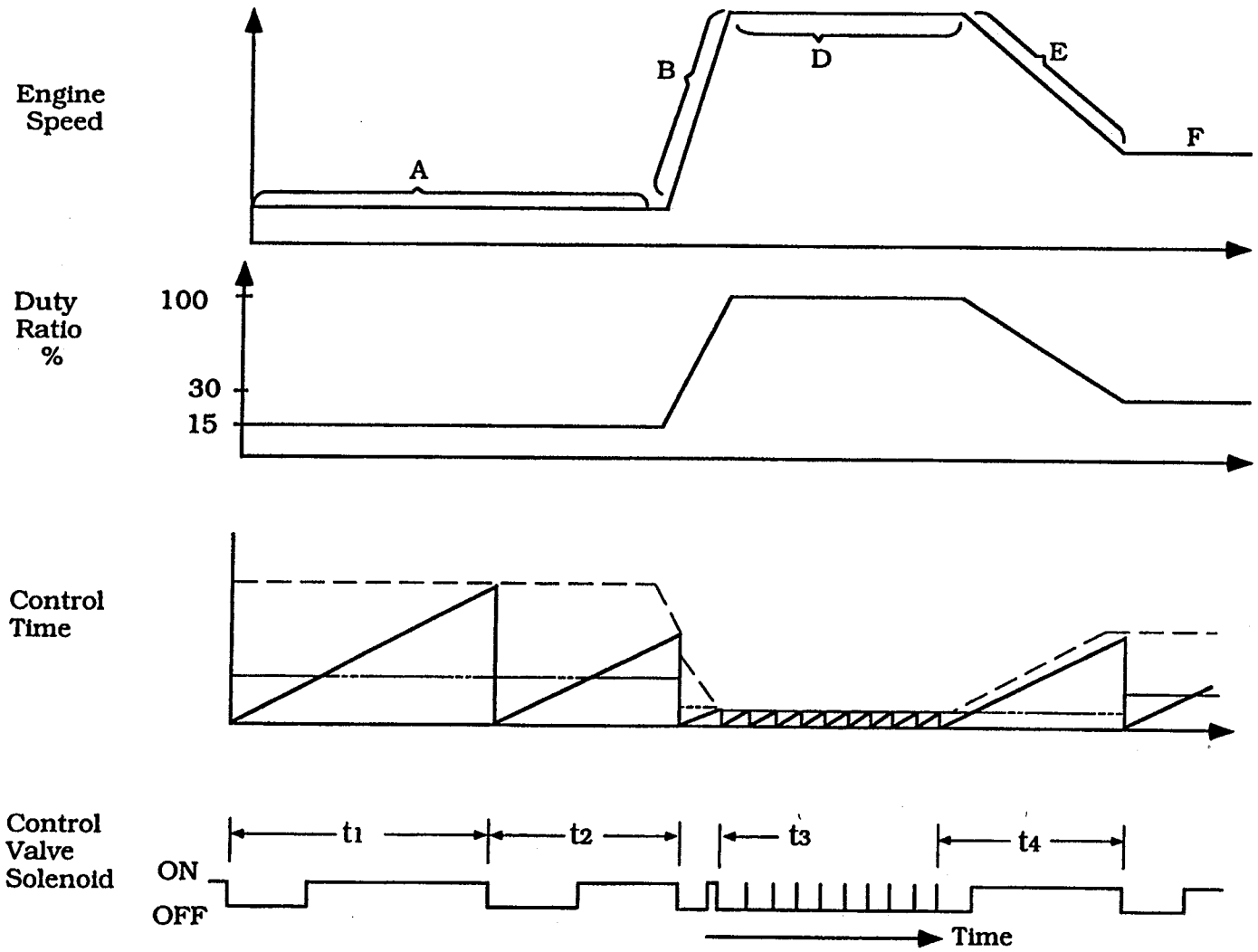
FIG. 7 is time diagram showing how the system operates in response to changed running conditions with engine speed, duty ratio, control time and control valve condition under these varying conditions.

FIG. 7 shows graphically how the system adapts to changes in engine running condition and referring first to the upper curve (engine speed) it will be seen that an operational mode is depicted where the engine first operates at an idle condition for a time period A, then gradually accelerates during a portion B to maximum engine speed, maintains maximum engine speed for a time period D, decelerates during a time period E to a final speed which is somewhat higher than idle F.

From the second curve (duty ratio) it will be seen that during the phase A the duty ratio read from FIG. 3, is held constant at 15%. However, as the speed increases during the phase B, the duty ratio also increases along with the curve of FIG. 3 up until the maximum duty ratio of 100% at wide open throttle. As the engine again decelerates from wide open throttle during the stage E, the duty ratio again falls to the duty ratio called for in the final engine speed F.

The lower two curves show the effect of the change in conditions on both the solenoid of the control valve 26 on and off conditions and the total control time per cycle which is determined by dividing the delivery time from FIG. 4 with the duty ratio of FIG. 3. As may be seen, the solenoid begins turned off and hence, the control valve 26 will deliver lubricant to the engine until the off time period has been reached as shown by the dot/dash line of FIG. 7, at which time the solenoid of the control valve 26 is turned on and lubricant is bypassed back to the lubricant tank 21. This continues for a complete cycle until the dotted line curve of the total time is reached at which time the program repeats by turning the solenoid of the control valve 26 off and resetting the control time. This first time cycle of operation is indicated at $t_1$.

During the next cycle, the solenoid of time is again held constant in accordance with the map of FIG. 4 and lubricant delivery is begun. Once the off time period has been reached (dot/dash line cross), the solenoid will be turned on again and lubricant delivery stopped. However, it should be noted that now the speed of the engine is increasing and, accordingly, the duty ratio called for will change and, accordingly, the control time period will fall as shown by the broken line curve of FIG. 7 and the solenoid of the control valve 26 will again be turned off, but now at a control time $t_2$.

One additional relatively short cycle $t_3$ will then occur until the condition at the start of the cycle indicates the engine is operating at maximum speed (range D). When this occurs, the program will call for a 100% duty ratio and hence, the system will supply lubricant continuously by maintaining the control valve 26 in its delivery position. However, the off time period will still vary in accordance with FIG. 4 and this off time period will be reduced significantly so that the system can quickly respond to a changed condition. Thus, when the engine begins its deceleration mode in the range E, the system will promptly respond at almost the instant of speed decrease and then function in accordance with FIG. 7 to set a new duty ratio and control time period, this being the time period $t_4$.

It should be readily apparent from the foregoing description, therefore, that the system is relatively simple and requires only a pair of comparators and a pair of simple maps so as to achieve not only efficient control but also quick response during transient conditions.

It is believed to be readily apparent that the foregoing control routine and operation is only one way in which the invention may be operated and, as noted above, rather than holding the delivery time constant during/each time control cycle, the delivery time may be varied and the non-delivery or return time varied. Various other changes and modifications may be made without departing from the spirit and scope of the invention, as defined by the appended claims.

I claim:

1. A lubricating system for supplying lubricant to an internal combustion engine comprising a lubricant pump for pumping lubricant, a control valve for receiving lubricant from said lubricant pump and operable cyclically between a delivery condition wherein lubricant is delivered to said engine for a delivery time and a condition wherein lubricant is not delivered to said engine for a non-delivery time, the sum of said delivery time and said non-delivery time for a cycle comprising the control time, the ratio of delivery time to control time for a given cycle comprising the duty ratio, means for sensing an engine running condition, and control means for controlling the amount of lubricant supplied to said engine during a given cycle by sensing the engine running condition at the beginning of a control time, holding one of the delivery and non-delivery times constant during that cycle in response to the sensed engine running condition at the beginning of that control time and varying the duty ratio by varying the other of said delivery and non-delivery time in the cycle in response to sensed engine running conditions after the initiation of the cycle.

2. A lubricating system as set forth in claim 1 wherein the lubricant pump comprises a reciprocating pump driven by the engine.

3. A lubricating system as set forth in claim 1 wherein the control valve maintains a non-delivery condition by returning lubricant from the lubricant pump back to the inlet side of the lubricant pump.

4. A lubricating system as set forth in claim 1 wherein the time held constant is the delivery time.

5. A lubricating system as set forth in claim 4 wherein the lubricant pump comprises a reciprocating pump driven by the engine.

6. A lubricating system as set forth in claim 5 wherein the control valve maintains a non-delivery condition by returning lubricant from the lubricant pump back to the inlet side of the lubricant pump.

7. A lubricating system as set forth in claim 4 further including means for varying the delivery time in response to variations in the engine running condition.

8. A lubricating system as set forth in claim 7 wherein the delivery time is not varied during a first range of engine running conditions.

9. A lubricating system as set forth in claim 8 wherein the first range of engine running conditions is low speed.

10. A lubricating system as set forth in claim 9 wherein the delivery time is held constant also at high speed running conditions.

11. A lubricating system as set forth in claim 10 wherein the delivery time is varied in a linear function between the constant low speed delivery time and the constant high speed delivery time.

12. A lubricating system as set forth in claim 8 wherein the one running condition is a high speed running condition.

13. A lubricating system as set forth in claim 1 wherein the cycle time is reduced in response to a running condition wherein changes in the running condition are likely to occur.

14. A lubricating system as set forth in claim 13 wherein the running condition is speed.

15. A lubricating system as set forth in claim 1 wherein the engine comprises a two cycle crankcase compression internal combustion engine.

16. A lubricating system as set forth in claim 15 wherein the lubricant pump comprises a reciprocating pump driven by the engine.

17. A lubricating system as set forth in claim 15 wherein the control valve maintains a non-delivery condition by returning lubricant from the lubricant pump back to the inlet side of the lubricant pump.

18. A lubricating system as set forth in claim 15 wherein the time held constant is the delivery time.

19. A lubricating system as set forth in claim 18 wherein the lubricant pump comprises a reciprocating pump driven by the engine.

20. A lubricating system as set forth in claim 19 wherein the control valve maintains a non-delivery condition by returning lubricant from the lubricant pump back to the inlet side of the lubricant pump.

21. A lubricating system as set forth in claim 19 further including means for varying the delivery time in response to variations in the engine running condition.

22. A lubricating system as set forth in claim 21 wherein the delivery time is not varied during a first range of engine running conditions.

23. A lubricating system as set forth in claim 22 wherein the first range of engine running conditions is low speed.

24. A lubricating system as set forth in claim 23 wherein the delivery time is held constant also at high speed running conditions.

25. A lubricating system as set forth in claim 24 wherein the delivery time is varied in a linear function between the fixed low speed delivery time and the fixed high speed delivery time.

26. A lubricating system as set forth in claim 22 wherein the one running condition is a high speed running condition.

27. A lubricating system as set forth in claim 5 wherein the cycle time is reduced in response to a running condition wherein changes in the running condition are likely to occur.

28. A lubricating system as set forth in claim 27 wherein the running condition is speed.

29. A lubricating method for supplying lubricant to an internal combustion engine comprising a lubricant pump for pumping lubricant, a control valve for receiving lubricant from said lubricant pump and operable cyclically between a delivery condition wherein lubricant is delivered to said engine for a delivery time and a condition wherein lubricant is not delivered to said engine for a non-delivery time, the sum of said delivery time and said non-delivery time for a cycle comprising the control time, the ratio of delivery time to control time for a given cycle comprising the duty ratio, said method comprising the steps of sensing an engine running condition, controlling the amount of lubricant supplied to said engine during a given cycle by sensing the engine running condition at the beginning of a control time, holding one of the delivery and non-delivery times constant during that cycle in response to the sensed engine running condition at the beginning of that control time and varying the duty ratio by varying the other of said delivery and non-delivery time in the cycle in response to sensed engine running conditions after the initiation of the cycle.

30. A lubricating method as set forth in, claim 29 wherein the non-delivery condition is obtained by returning lubricant from the lubricant pump back to the inlet side of the lubricant pump.

31. A lubricating method as set forth in claim 29 wherein the time held constant is the delivery time.

32. A lubricating method as set forth in claim 31 further comprising the step of varying the delivery time in response to variations in the engine running condition.

33. A lubricating method as set forth in claim 32 wherein the delivery time is not varied during a first range of engine running conditions.

34. A lubricating method as set forth in claim 33 wherein the first range of engine running conditions is low speed.

35. A lubricating method as set forth in claim 34 wherein the delivery time is held constant also at high speed running conditions.

36. A lubricating method as set forth in claim 35 wherein the delivery time is varied in a linear function between the fixed low speed delivery time and the fixed high speed delivery time.

37. A lubricating method as set forth in claim 33 wherein the one running condition is a high speed running condition.

38. A lubricating method as set forth in claim 29 wherein the cycle time is reduced in response to a running condition wherein changes in the running condition are likely to occur.

39. A lubricating method as set forth in claim 38 wherein the running condition is speed.

* * * * *